US011603739B2

(12) United States Patent
Petty et al.

(10) Patent No.: US 11,603,739 B2
(45) Date of Patent: Mar. 14, 2023

(54) ELECTRIC, BATTERY-POWERED WIRELINE SYSTEMS

(71) Applicant: Texas Wireline Manufacturing, Fort Worth, TX (US)

(72) Inventors: Mark Alan Petty, Burleson, TX (US); Dawn Marie Petty, Burleson, TX (US)

(73) Assignee: Texas Wireline Manufacturing, Fort Worth, TX (US)

( * ) Notice: Subject to any disclaimer, the term of this patent is extended or adjusted under 35 U.S.C. 154(b) by 0 days.

(21) Appl. No.: 17/317,395

(22) Filed: May 11, 2021

(65) Prior Publication Data

US 2022/0364442 A1 Nov. 17, 2022

(51) Int. Cl.
*E21B 19/08* (2006.01)
*E21B 41/00* (2006.01)
*E21B 17/20* (2006.01)

(52) U.S. Cl.
CPC ..... *E21B 41/0085* (2013.01); *E21B 17/206* (2013.01); *E21B 19/08* (2013.01)

(58) Field of Classification Search
CPC .... E21B 41/0085; E21B 19/08; E21B 19/081; E21B 19/083; E21B 19/084; E21B 19/086; E21B 19/087; E21B 19/089; E21B 19/09
See application file for complete search history.

(56) References Cited

U.S. PATENT DOCUMENTS 4,037,662 A 7/1977 Bowling
10,113,376 B2 10/2018 Bjørnenak
2008/0265226 A1 10/2008 Richards
2009/0084558 A1 4/2009 Bloom
2009/0255728 A1 10/2009 Spencer et al.
2014/0077600 A1* 3/2014 Cryer ..... E21B 41/00 307/48
2014/0174727 A1 6/2014 Huizer
2014/0284108 A1 9/2014 Pendleton et al.
2018/0355682 A1* 12/2018 Pessin ..... G02B 6/4413
2019/0177137 A1* 6/2019 De Matos ..... E21B 19/22
2020/0131862 A1 4/2020 Phelps et al.
2020/0224508 A1 7/2020 Chapman et al.
2020/0224515 A1 7/2020 Bowman
2021/0003000 A1 1/2021 Phelps et al.

FOREIGN PATENT DOCUMENTS

WO 2020159375 A1 8/2020

* cited by examiner

*Primary Examiner* — Kristyn A Hall
(74) *Attorney, Agent, or Firm* — Vorys, Safer, Seymour and Pease LLP

(57) ABSTRACT

A wireline system includes an operations cabin with a plurality of electrical devices, and a winch that includes an electric winch motor operable to drive a drum to manipulate a wireline cable. A first engine and a first electric generator are each arranged within the operations cabin and generate electrical power, a second electric generator driven by a second engine via a power takeoff to generate electrical power, and an umbilical extends from the operations cabin to an external energy source to provide electrical power. A battery pack is arranged within the operations cabin and includes rechargeable batteries communicably coupled to the electric generators and the umbilical, wherein the battery pack solely provides electrical power to the electric winch motor and the electrical devices, and wherein the electric generators and the external energy source provide electrical power to recharge the rechargeable batteries.

22 Claims, 6 Drawing Sheets

ELECTRIC, BATTERY-POWERED WIRELINE SYSTEMS

BACKGROUND

Oil and gas exploration and production generally involves drilling boreholes and converting the boreholes into permanent well installations such as production wells, injections wells, or monitoring wells. To complete a well installation, a liner or casing is lowered into the borehole and cemented in place. Perforating, packing, and other downhole operations may then be performed along the length of the well installation to create different production or injection zones that enhance hydrocarbon recovery efficiency.

At times, it may be desirable to obtain information about the subterranean oil and gas deposits or to perform various well treatment or intervention operations within the completed wellbore. To accomplish this, well operators can lower various tools or tool strings into the wellbore using a wireline system, alternately referred to as a "slickline" system. Wireline systems are able to deploy a wide variety of tools and technologies downhole, including wellbore logging tools and tools capable of manipulating valves, actuating well packers, or perforating downhole tubulars.

A typical wireline system includes a wireline cable, a drum (spool) for storing the wireline cable, and a winch for rotating the drum and thereby conveying the wireline cable in and out of the wellbore. To operate the wireline system, the winch is powered to rotate the drum, which causes the wireline cable to be either fed from or wound onto the drum.

In conventional wireline systems, the winch is commonly powered with a hydraulic motor driven by a hydraulic pump. In truck-mounted wireline systems, the hydraulic pump is often driven by the truck motor via a power take off (PTO). Maintenance and repairs on hydraulic drive systems, however, can be costly and occur often. For instance, hydraulic drive systems have numerous potential leak points, the potential for hose bursts due to over-pressurization, the potential for failure due to temperature fluctuations, they require more horsepower to operate, and are generally less efficient than counterpart electrical systems.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to wellbore intervention operations and, more particularly, to electric-powered wireline systems that use no hydraulics.

Embodiments included herein describe a wireline system that includes an operations cabin housing a plurality of electrical devices, and a winch arranged adjacent the operations cabin and including an electric winch motor operable to drive a drum to manipulate a wireline cable. Electrical power is generated or obtained by a plurality of power sources including a first engine and a first electric generator each arranged within the operations cabin, a second electric generator arranged within the operations cabin and driven by a second engine via a power takeoff, and an umbilical configured to be coupled to an external energy source. A battery pack may be arranged within the operations cabin and includes one or more rechargeable batteries communicably coupled to the first and second electric generators and the umbilical. The battery pack may solely provide electrical power to the electric winch motor and the plurality of electrical devices, and the first and second electric generators and the external energy source may selectively provide electrical power to recharge the one or more rechargeable batteries.

Figure 1:
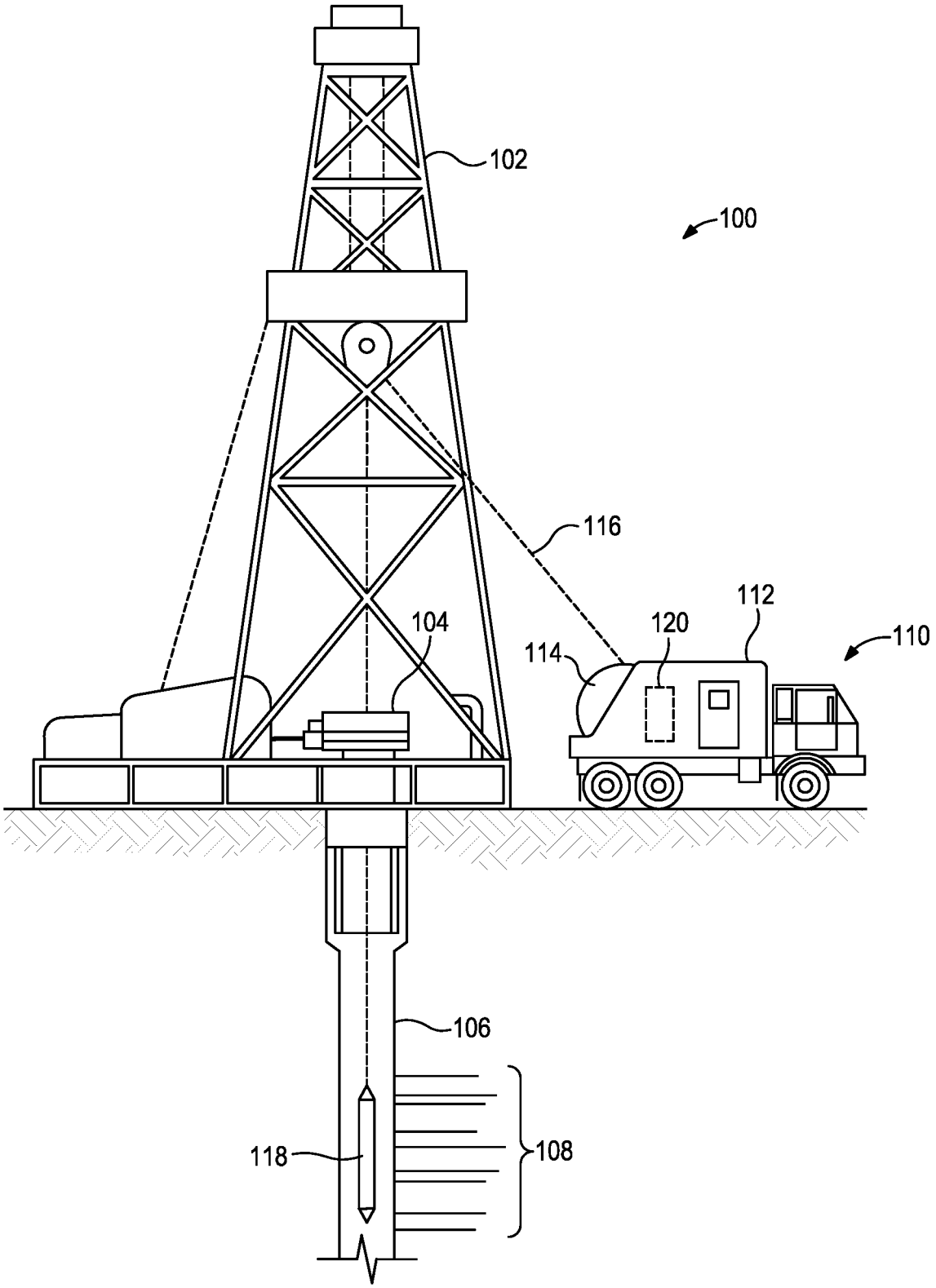
FIG. 1 is a schematic diagram of an example wellbore system that may employ the principles of the present disclosure, according to one or more embodiments.

FIG. 1 is a schematic diagram of an example wellbore system 100 that may employ the principles of the present disclosure, according to one or more embodiments. As illustrated, the wellbore system 100 may include a platform facility 102 (e.g., a derrick or the like) positioned at the Earth's surface and including a wellhead installation 104. A wellbore 106 is drilled into the Earth and extends from the wellhead installation 104 into one or more subterranean formations 108. In offshore drilling operations, a volume of water may separate the platform facility 102 and the wellbore 106. The wellhead installation 104 regulates production from the wellbore 106 while simultaneously providing access into the wellbore 106.

The wellbore system 100 may further include a wireline system 110 configured to undertake various wellbore intervention operations. In the illustrated embodiment, the wireline system 110 includes a wireline truck 112 and a cable drum (spool) 114 is rotatably mounted to the wireline truck 112. A wireline cable 116 extends from the drum 114 and is directed into the wellbore 106 via the wellhead installation 104. One or more downhole tools 118 may be attached to the wireline cable 116 and suspended within the wellbore 106. In some embodiments, the downhole tool(s) 118 may comprise a wireline instrument sonde configured to obtain various downhole measurements. In such embodiments, for example, the instrument sonde may comprise one or more resistivity logging tools configured to detect and transmit information about the wellbore 106 and the adjacent formations 108. In other embodiments, the downhole tool(s) 118 may be designed to undertake one or more downhole operations within the wellbore 106, such as opening or closing valves, actuating a wellbore packer, perforating a section of the wellbore 106, etc.

The wireline cable 116 may include conductors for conveying power to the downhole tool(s) 118 and for facilitating communication between the wireline truck 112 and the downhole tool(s) 118. In the illustrated embodiment, the wireline truck 112 may include an enclosed operations cabin accessible by an operator and serving as an operating facility. A computer system 120 may be included in the operations cabin and operable to control the wireline system 110, including any operation of the downhole tool(s) 118.

Figure 2:
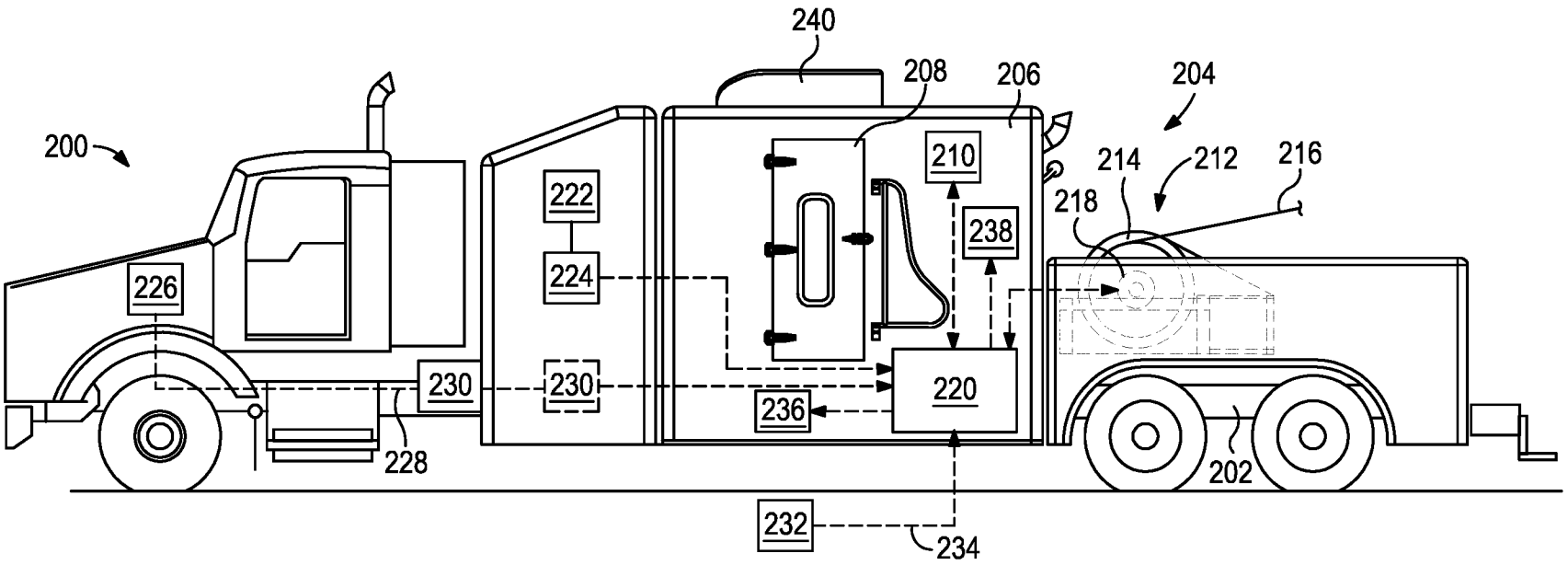
FIG. 2 is a side view of an example wireline truck, according to one or more embodiments of the present disclosure.

FIG. 2 is a side view of an example wireline truck 200, according to one or more embodiments of the present disclosure. The wireline truck 200 may be the same as or similar to the wireline truck 112 of FIG. 1 and, therefore, may replace the wireline truck 112 or otherwise be used in the wellbore system 100 (FIG. 1). The wireline truck 200 includes a chassis 202 and a wireline system 204 may be mounted to or otherwise secured to the chassis 202 such that moving (driving) the truck 200 correspondingly transports the wireline system 204.

An operations cabin 206 is mounted to the chassis 202 and includes a general area for operational access by an operator, and may further provide one or more specialized compartments or areas for housing (storing) various electrical components used to operate the wireline system 204. The general operations area of the operations cabin 206 is accessible by an operator via a hinged door 208, while the specialized compartments that house the various electrical components may be accessible via smaller hinged doors (not shown) included about the periphery of the operations cabin 206. Among other electrical equipment and devices, a computer system 210 is generally housed (included) within the operations cabin 206 and may be configured and otherwise programmed to control some or all of the facets and operations of the wireline system 204.

The wireline system 204 may further include a winch 212, which includes a drum (spool) 214 and a wireline cable 216 wrapped about the drum 214. The winch 212 is powered by an electric winch motor 218, which is operatively coupled to the drum 214 such that operating (actuating) the electric winch motor 218 correspondingly rotates the drum 214 and thereby either feeds the wireline cable 216 from the drum 214 or winds the wireline cable 216 onto the drum 214. In at least one embodiment, the electric winch motor 218 may comprise a 75 horsepower (hp) electric motor, but could alternatively be a larger or smaller electric motor, depending on the wireline application needs.

The computer system 210 may be in communication with the electric winch motor 218 to operate the electric winch motor 218. More specifically, the computer system 210 may control the frequency and/or the amplitude of the electrical power supplied to the electric winch motor 218, which correspondingly controls the rotational speed and torque applied to the drum 214.

The electrical power or energy required to operate the electric winch motor 218 may be provided through an onboard battery pack 220 arranged within the operations cabin 206 and otherwise within a specialized compartment for housing electrical components. The battery pack 220 may comprise one or more rechargeable batteries, such as a plurality of rechargeable lithium-ion batteries, but could alternatively comprise other types of rechargeable batteries, without departing from the scope of the disclosure. The specific number of batteries included in the battery pack 220 will depend largely on the application, the size (capacity) of the batteries, and the needs of the particular wireline system 204. In some embodiments, however, more than one-hundred rechargeable batteries may be included in the battery pack 220.

The battery pack 220 may be powered and otherwise selectively recharged using a plurality of power sources. In some embodiments, for example, the wireline system 204 may include an internal combustion engine 222 that drives a first electric generator 224. The first electric generator 224 communicates with the battery pack 220 such that operating the internal combustion engine 222 generates electrical power at the first electric generator that is transmitted to the battery pack 220 to recharge the batteries. The internal combustion engine 222 may comprise any known type of internal combustion engine, including both diesel and non-diesel engine types. In at least one embodiment, the internal combustion engine 222 may comprise a Tier 3, 50 hp diesel engine. As will be appreciated, however, the internal combustion engine 222 may alternatively be larger or smaller, depending on application requirements.

In addition thereto, the battery pack 220 may alternatively be powered or otherwise selectively recharged by operating the wireline truck 200 itself. More specifically, the wireline truck 200 includes an onboard engine 226 configured to drive a power takeoff (PTO) 228. The wireline system 204 may further include a second electric generator 230 driven by the PTO 228 to generate electrical power, and the second electric generator 230 may communicate with the battery pack 220 to recharge the batteries. In some embodiments, the second electric generator 230 may be mounted directly to the PTO 228 external but adjacent to the operations cabin 206. In other embodiments, however, the second electric generator 230 (shown in dashed lines) may be arranged within the operations cabin 206 and the PTO 228 may be operatively coupled thereto, either directly or indirectly. In some embodiments, the first and second electric generators 224, 230 may be the same size and otherwise capable of outputting similar amounts of power. In other embodiments, one of the generators 224, 230 may be larger or smaller, depending on application requirements, and without departing from the scope of the disclosure.

The onboard engine 226 may comprise, for example, a diesel-powered engine, but could alternatively comprise any other type of internal combustion engine. In conventional, hydraulic applications, the onboard engine 226 would be required to output approximately 150 hp to run the hydraulics systems at peak conditions. In the present disclosure, however, the onboard engine 226 may need only a minimum of 50 hp to run the second electric generator 230, thus realizing a significant power savings and allowing the onboard engine 226 to be smaller and more efficient.

In addition thereto, the battery pack 220 may alternatively be powered or otherwise selectively recharged using an external energy source 232 in communication with the battery pack 220 via an umbilical 234. The external energy source 232 can include, but is not limited to, electrical grid power, power derived from a local renewable resource (e.g., solar, wind, etc.), a portable genset (e.g., combination of diesel engine and electric generator), or any combination thereof. The umbilical 234 may be able to extend between the battery pack 220 and any of the external energy sources 232.

Accordingly, the electric generators 224, 230, and the external energy source 232 comprise redundant power sources for the wireline truck 200 to provide power to the battery pack 220. As will be appreciated by those skilled in the art, this power generating redundancy ensures that the wireline system 204 experiences no unexpected downtime. If one of the power sources fails, another can be immediately selected to help maintain the wireline system 204 running until operations are complete and the unit can be inspected. Moreover, while switching between power sources, the battery pack 220 provides continuous and constant power. Moreover, these redundant power sources require reduced maintenance, as compared with traditional hydraulic power systems.

The computer system 210 may be powered by the battery pack 220, but may further communicate with the battery pack 220 to selectively regulate the recharging and discharging processes of the battery pack 220. More specifically, the computer system 210 may be configured to monitor in real-time the capacity and power level of the battery pack 220 during operation of the winch 212 and as the battery pack 220 is being recharged. In some embodiments, the computer system 210 may be in communication with each generator 224, 230 and may be configured to autonomously regulate operation of one or both generators 224, 230 as needed to recharge the battery pack 220. In at least one embodiment, for example, once the power level of the battery pack 220 descends below a predetermined lower threshold, the computer system 210 may autonomously send a command signal to operate the internal combustion engine 222 and thereby start charging the battery pack 220 via the first electric generator 224. The predetermined lower threshold may be, for example, 50% capacity, 25% capacity, 10% capacity, or any other desired percent capacity of the battery pack 220. Alternatively, the computer system 210 may send a command signal that causes operation of the onboard engine 226 to start charging the battery pack 220 via the second electric generator 224. In yet other embodiments, the computer system 210 may allow the influx of electrical power from the external energy source 232 via the umbilical 234 to recharge the battery pack 220. Each power source defaults back to the battery pack 220, which automatically eliminates downtime since electrical power will never be interrupted.

In other embodiments, or in addition thereto, the computer system 210 may be configured to communicate with an operator in real-time regarding the capacity and power level of the battery pack 220. Such communication may be, for example, via a wireless communication to a handheld device, an audible or visual alert, or alternatively via a graphical user interface (GUI) or monitor (control display) arranged within the operations cabin 206. In such embodiments, when the power level of the battery pack 220 descends below a predetermined lower threshold, the computer system 210 may send an alert to the operator prompting the operator to action to restore the battery pack 220 to a predetermined minimum power level. The minimum power level may be, for example, 50% capacity, 75% capacity, 90% capacity, or any other desired percent capacity of the battery pack 220. Once one power source becomes inoperable or a change is merely desired, the operator may be able to select another power source (e.g., from the control display in the operations cabin 206).

In some embodiments, the computer system 210 may be programmed to instruct the operator to engage one of the generators 224, 230 or the external power source 232 to recharge the batteries. Accordingly, upon receiving the alert from the computer system 210, the operator may have the option of selecting the desired power source to recharge the battery pack 220. The operator may then manually or electronically commence power generation via the generators 224, 230 or direct power flow to the battery pack 220 from the external power source 232. In at least one embodiment, the GUI of the computer system 210 may comprise a touchscreen interface engageable by the operator to trigger battery recharging by any of the generators 224, 230 and the external power source 232. Moreover, since the battery pack 220 is providing a constant stream of electrical power, switching between recharging power sources does not result in any system downtime and the electrical power supply is never interrupted.

In addition to operating the winch 212 to deploy (unwind) the wireline cable 216 from the drum 214, or to wind the wireline cable 216 onto the drum 214, the electric winch motor 218 may be further operable to generate electrical energy that recharges the battery pack 220. More specifically, as a downhole tool (e.g., the downhole tool 118 of FIG. 1) attached to the wireline cable 216 descends within a wellbore (e.g., the wellbore 106 of FIG. 1), gravitational forces acting on the downhole tool 118 may cause the drum 214 to rotate and thereby release mechanical (kinetic) energy. Rotating the drum 214 provides torque that rotates the electric winch motor 218 in reverse, and thereby converts the electric winch motor 218 into a motor-generator capable of generating electricity (electrical power). The electricity generated by the electric winch motor 218 may be transmitted to the battery pack 220 to selectively recharge the batteries. The computer system 210 may monitor the current state of the battery pack 220 and the amount of electrical power generated by the electric winch motor 218, and may send a command signal to route generated electricity from the electric winch motor 218 to the battery pack 220 for battery recharging as needed.

In some embodiments, however, the battery pack 220 may not be able to accommodate or absorb the influx of electricity generated by the electric winch motor 218. More specifically, when the power level in the battery pack 220 is above the minimum power level while deploying the wireline cable 216, the computer system 210 may be programmed and otherwise configured to divert the excess generated electrical power to a load (resistor) bank 236. The load bank 236 may be configured to dissipate the excess energy in the form of heat. In some embodiments, the generated heat may be removed by a forced air- or water-cooling system.

In some embodiments, the wireline system 204 may further include a power inverter or transformer 238 in communication with the battery pack 220. In at least one embodiment, the power inverter 238 may comprise an 8 kV inverter, but could alternatively be any size or of any capacity to fit a particular wireline application or system. The power inverter 238 may be configured to convert direct current (DC) electricity provided by the battery pack 220 to alternating current (AC) electricity that can power all electronics and electrical devices that may be present in the operations cabin 206. Example electrical devices included in the operations cabin 206 and powered by the battery pack 220 include, but are not limited to, the computer system 210, one or more wall outlets (e.g., 110V, etc.), one or more computer screens, one or more television monitors, one or more device charger, one or more heaters, an air conditioner 240, a mooring system, one or more security cameras, and any other electrical device that may be included in the operations cabin 206. In at least one embodiment, the power inverter 238 may rectify electricity received by the battery pack 220 to produce DC electricity at any desired voltage for a variety of uses.

Figure 3:
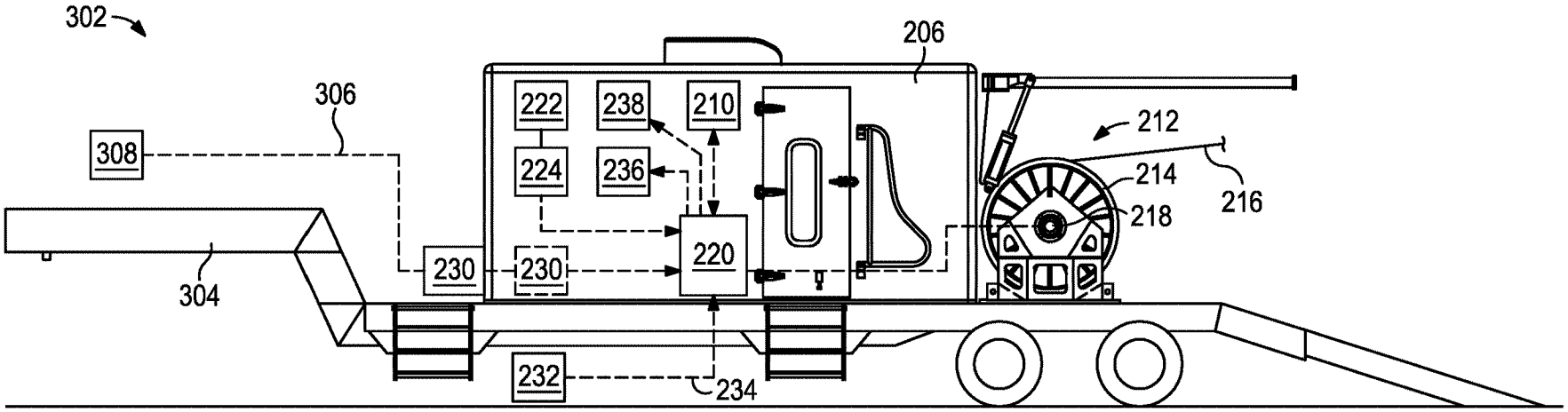
FIG. 3 is a side view of an example wireline system, according to one or more embodiments.

FIG. 3 is a side view of another example wireline system 302, according to one or more embodiments. The wireline system 302 may be similar in some respects to the wireline system 204 of FIG. 2 and, therefore, may be best understood with reference thereto, where like numerals will refer to similar components not described again in detail. In the illustrated embodiment, the wireline system 302 is mounted to a trailer 304 that may be towed to a well site for well intervention operations. The trailer 304 may comprise, for example, a semi-tractor trailer or a drop-deck trailer.

The wireline system 302 includes the operations cabin 206, which houses the computer system 210 operable to control all facets of the wireline system 302. The wireline system 302 also includes the winch 212, which includes the drum 214 and the wireline cable 216, and is powered by the electric winch motor 218. Moreover, the onboard battery pack 220 provides the electrical power required to operate the electric winch motor 218. In the wireline system 302, the rechargeable batteries included in the battery pack 220 may be recharged using the first electric generator 224 driven by the internal combustion engine 222, or alternatively by one or more of the external energy sources 232 in communication with the battery pack 220 via the umbilical 234. In at least one embodiment, however, the wireline system 302 may further include the second electric generator 230, which may be powered via a PTO 306 operatively coupled to an external engine 308, such as the engine included in a vehicle used to transport the trailer 304 to a well site, or any other vehicle.

As in the wireline system 204 of FIG. 2, the computer system 210 of the wireline system 302 may control operation of the electric winch motor 218 using power derived from the battery pack 220. The computer system 210 may also be configured to selectively regulate the recharging process of the battery pack 220 via the electric generators 224, 230 and the external energy sources 232, or two or more of these power sources simultaneously. Furthermore, in the wireline system 302, the electric winch motor 218 may also be operable to generate electrical energy to recharge the battery pack 220 as a downhole tool attached to the wireline cable 216 descends within a wellbore, as generally described above. Any excess electrical power generated by the electric winch motor 218 may be diverted to the load bank 236 and dissipated in the form of heat, as also described above. Lastly, the power inverter 238 may receive power from the battery pack 220 and convert that power into usable electricity to power all electronics and electrical devices that may be present in the operations cabin 206.

Figure 4:
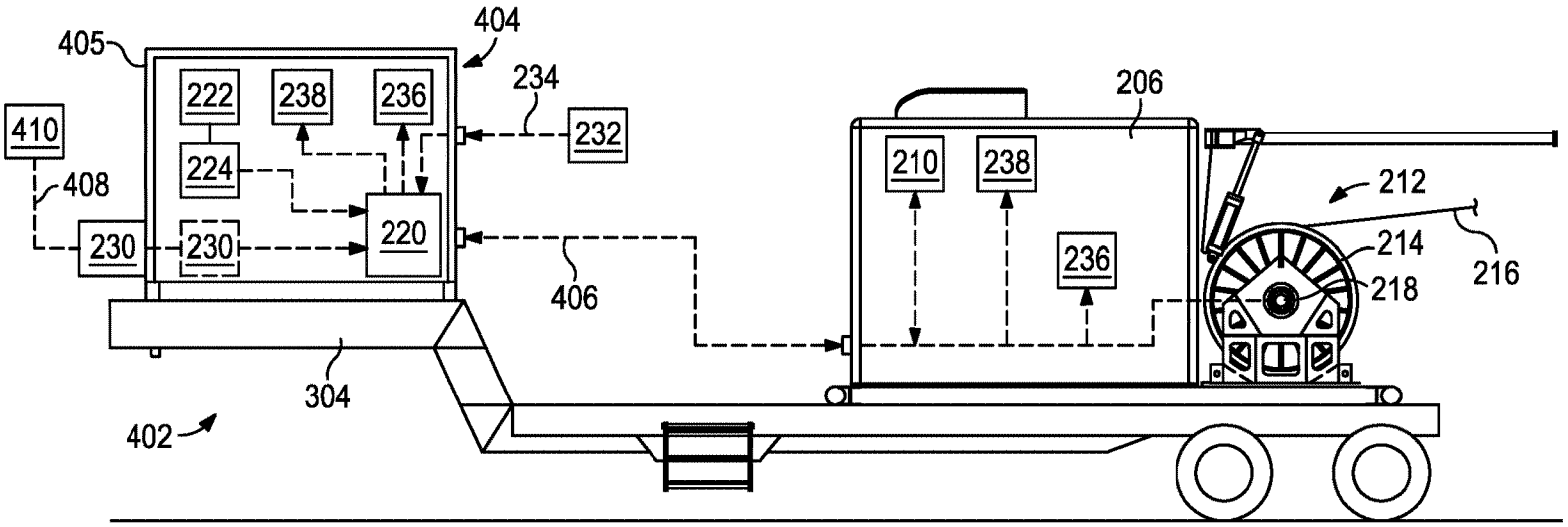
FIG. 4 is a side view of another example wireline system, according to one or more additional embodiments.

FIG. 4 is a side view of another example wireline system 402, according to one or more additional embodiments. The wireline system 402 may be similar in some respects to the wireline system 302 of FIG. 3 and, therefore, may be best understood with reference thereto, where like numerals will refer to similar components not described again in detail. Similar to the wireline system 302, the wireline system 402 is mounted to the trailer 304 and includes the operations cabin 206, which houses the computer system 210 operable to control all facets of the wireline system 402. Moreover, the wireline system 402 includes the winch 212, which includes the drum 214 and the wireline cable 216, and is powered by the electric winch motor 218.

Unlike the wireline system 302 of FIG. 3, however, the wireline system 402 includes a power pack module 404 separate from the operations cabin 206. The power pack module 404 provides a rigid housing 405 that houses (contains) all the electrical components needed to power the wireline system 402, including the electric winch motor 218. The power pack module 404 may be communicably coupled to the operations cabin 206 via one or more umbilicals 406 capable of transmitting electrical power required to operate the wireline system 402. The umbilical(s) 406 may also be configured to transmit electrical signals used to facilitate communication between the computer system 210 and the components housed within the power pack module 404.

In some embodiments, as illustrated, the power pack module 404 may be mounted to the trailer 304. In other embodiments, however, the power pack module 404 may comprise a standalone structure (e.g., a skid) that can be transported independently to a well site and situated near the trailer 304. In such embodiments, once delivered to the well site adjacent the trailer 304, an operator may electrically couple the power pack module 404 to the operations cabin 206 with the umbilical(s) 406.

As illustrated, the power pack module 404 may include (house, contain, etc.) the battery pack 220. In at least one embodiment, however, the battery pack 220 may be arranged within the operations cabin 206. The internal combustion engine 222 and the first electric generator 224 may also be housed within the power pack module 404 and used to recharge the battery pack 220. Alternatively, the battery pack 220 may be in communication with one or more of the external energy sources 232 via the umbilical 234 to recharge the battery pack 220. In at least one embodiment, the power pack module 404 may further include the second electric generator 230, which may be powered via a PTO 408 operatively coupled to an external engine 410, such as the engine included in a vehicle used to transport the trailer 304 to a well site, or any other vehicle.

The computer system 210 of the wireline system 402 may selectively regulate the recharging of the battery pack 220 via the electric generators 224, 230 and the external energy sources 232, or two or more of these power sources simultaneously. Alternatively, the computer system 210 may communicate with an operator in real-time to alert the operator when the power level descends below the predetermined lower threshold and prompt operator action to bring the power level back to the predetermined minimum power level.

Furthermore, the electric winch motor 218 in the wireline system 402 may also be operable in reverse to generate electrical energy to recharge the battery pack 220, as generally described herein, and any excess electrical power generated by the electric winch motor 218 may be diverted to the load bank 236 and dissipated as heat, as also described herein. In some embodiments, the load bank 236 may be arranged in the power pack module 404, but may alternatively be housed within the operations cabin 206, without departing from the scope of the disclosure. Lastly, the power inverter 238 may be arranged within the operations cabin 206 or the power pack module 404 and configured to receive and convert power from the battery pack 220 into usable electricity consumed by all electronics and electrical devices present in the operations cabin 206.

Figure 5:
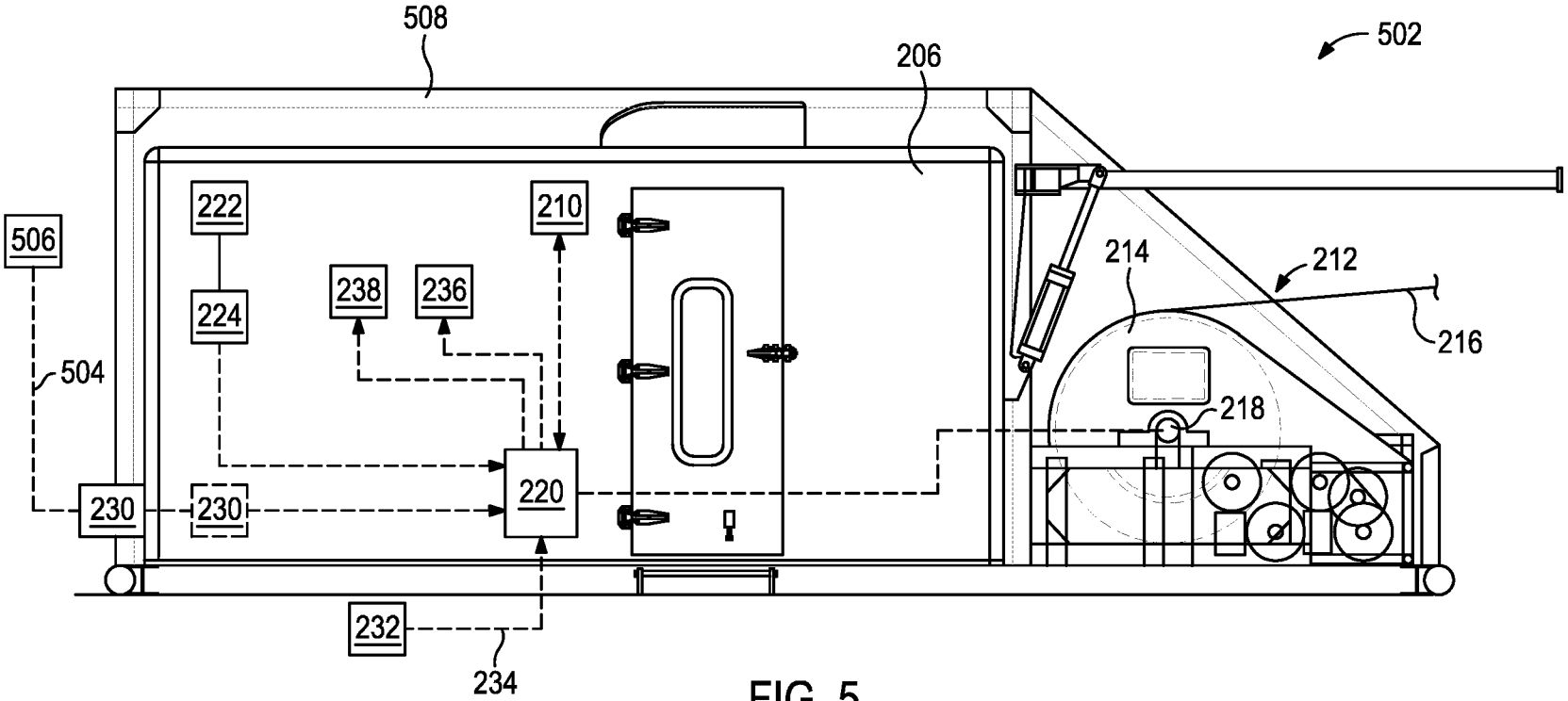
FIG. 5 is a side view of another example wireline system, according to one or more additional embodiments.

FIG. 5 is a schematic side view of another example wireline system 502, according to one or more additional embodiments. The wireline system 502 may be similar in some respects to the wireline system 302 of FIG. 3 and, therefore, may be best understood with reference thereto, where like numerals will refer to similar components not described again in detail. As illustrated, the wireline system 502 includes the operations cabin 206, which houses the computer system 210 operable to control all facets of the wireline system 502. The wireline system 502 also includes the winch 212, which includes the drum 214 and the wireline cable 216, and is powered by the electric winch motor 218. Moreover, the onboard battery pack 220 provides the electrical power required to operate the electric winch motor 218, and all other electrical devices included in the wireline system 502. As illustrated, the battery pack 220 may be arranged within the operations cabin 206 and otherwise within a dedicated compartment for electrical equipment.

The wireline system 502 further includes the first electric generator 224 driven by the internal combustion engine 222 to recharge the battery pack 220. Alternatively, or in addition thereto, the battery pack 220 may be recharged using one or more of the external energy sources 232 in communication with the battery pack 220 via the umbilical 234. In yet other embodiments, or in addition thereto, the wireline system 502 may further include the second electric generator 230, which may be powered via a PTO 504 operatively coupled to an external engine 506.

In the illustrated embodiment, the wireline system 502 is mounted to and otherwise accommodated by a skid 508. The skid 508 may comprise a rigid framework that generally surrounds the wireline system 502, and various components of the wireline system 502 may be secured thereto for transport, such as the operations cabin 206 and the winch 212. The skid-mounted wireline system 502 may be delivered to a well site on a flatbed truck, for example, and placed on the ground adjacent a wellhead with a crane. The skid 508 may be able to accommodate all electrical and mechanical components necessary to run a wireline intervention operation.

As with the other wireline systems described herein, the computer system 210 of the wireline system 502 may control operation of the electric winch motor 218 using power derived from the battery pack 220. Moreover, the computer system 210 may also selectively regulate the recharging process of the battery pack 220 via the electric generators 224, 230 and the external energy sources 232, or two or more of these power sources simultaneously. Furthermore, in the wireline system 502, the electric winch motor 218 may also be operable to generate electrical energy to recharge the battery pack 220 as a downhole tool attached to the wireline cable 216 descends within a wellbore, as generally described above. Any excess electrical power generated by the electric winch motor 218 may be diverted to the load bank 236 and dissipated in the form of heat, as also described above. Lastly, the power inverter 238 may receive power from the battery pack 220 and convert that power into usable electricity to power all electronics and electrical devices that may be present in the operations cabin 206.

Figure 6:
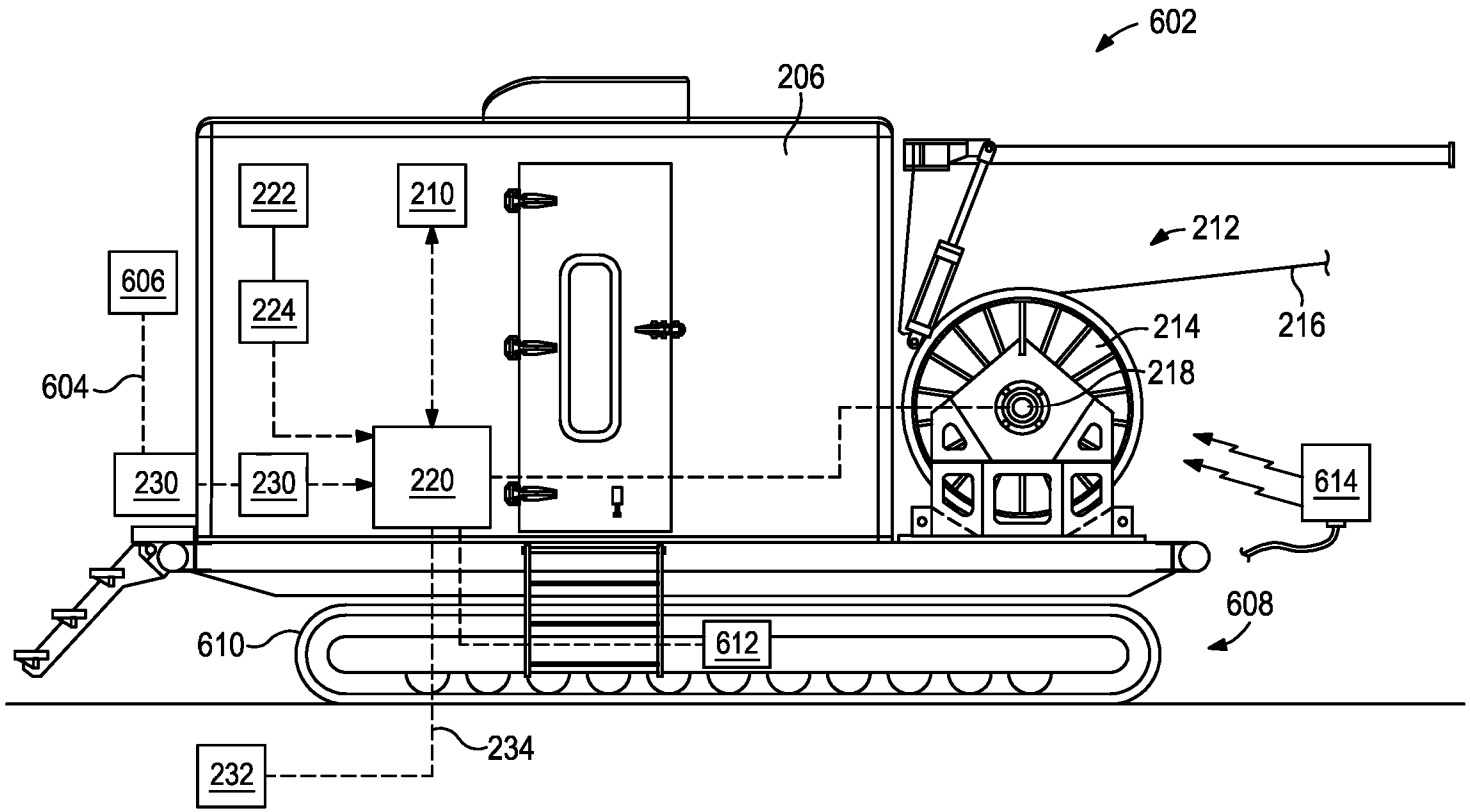
FIG. 6 is a side view of another example wireline system, according to one or more additional embodiments.

FIG. 6 is a schematic side view of yet another example wireline system 602, according to one or more additional embodiments. The wireline system 602 may be similar in some respects to the wireline system 502 of FIG. 5 and, therefore, may be best understood with reference thereto, where like numerals will refer to similar components not described again in detail. More specifically, the wireline system 602 includes the operations cabin 206, which houses the computer system 210 operable to control all facets of the wireline system 602. The wireline system 602 also includes the winch 212, including the drum 214 and the wireline cable 216, and is powered by the electric winch motor 218. The onboard battery pack 220 provides the electrical power required to operate the electric winch motor 218, and all other electrical devices included in the wireline system 602. The battery pack 220 may be arranged within the operations cabin 206 and otherwise within a dedicated compartment for electrical equipment.

To recharge the battery pack 220, the wireline system 602 further includes the first electric generator 224 driven by the internal combustion engine 222. Alternatively, or in addition thereto, the battery pack 220 may be recharged using one or more of the external energy sources 232 in communication with the battery pack 220 via the umbilical 234. In yet other embodiments, or in addition thereto, the wireline system 602 may further include the second electric generator 230, which may be powered via a PTO 604 operatively coupled to an external engine 606.

In the illustrated embodiment, the wireline system 602 is mounted to and movable via a continuous track assembly 608. The continuous track assembly 608 may include one or more continuous tracks 610. In the illustrated embodiment, the continuous track assembly 608 includes two continuous tracks 610 arranged side by side (only one visible), but could have more or less than two, without departing from the scope of the disclosure. The continuous track assembly 608 may further include one or more electric motors 612 configured to drive the continuous tracks 610, and the battery pack 220 may provide the electrical power necessary to operate the electric motors 612. Accordingly, the continuous track assembly 608 facilitates mobility for the wireline system 602. The efficiency of the continuous tracks 610, as compared to conventional wheels, may prove advantageous when attempting to locate the wireline system 602 in remote and difficult terrain.

In some embodiments, operation of the continuous track assembly 608 may be carried out via the computer system 210. In such embodiments, an operator may be able to interface with the computer system 210 while present within the operations cabin 206 and guide operation of the continuous track assembly 608 to move the wireline system 602. In other embodiments, however, an operator may be able to operate the continuous track assembly 608 at a location outside of the operations cabin 206. In such embodiments, the wireline system 602 may further include a handheld remote 614 that may communicate with the computer system 210 via any wired or wireless communication technology. In such embodiments, an operator may operate the continuous track assembly 608 standing a short distance from the wireline system 602 by using the handheld remote 614.

As with the other wireline systems described herein, the computer system 210 of the wireline system 602 may control operation of the electric winch motor 218 using power derived from the battery pack 220. Moreover, the computer system 210 may also selectively regulate the recharging process of the battery pack 220 via the electric generators 224, 230 and the external energy sources 232, or two or more of these power sources simultaneously. Furthermore, in the wireline system 602, the electric winch motor 218 may also be operable to generate electrical energy to recharge the battery pack 220 as a downhole tool attached to the wireline cable 216 descends within a wellbore, as generally described above. Any excess electrical power generated by the electric winch motor 218 may be diverted to the load bank 236 and dissipated in the form of heat, as also described above. Lastly, the power inverter 238 may receive power from the battery pack 220 and convert that power into usable electricity to power all electronics and electrical devices that may be present in the operations cabin 206.

Figure 7:
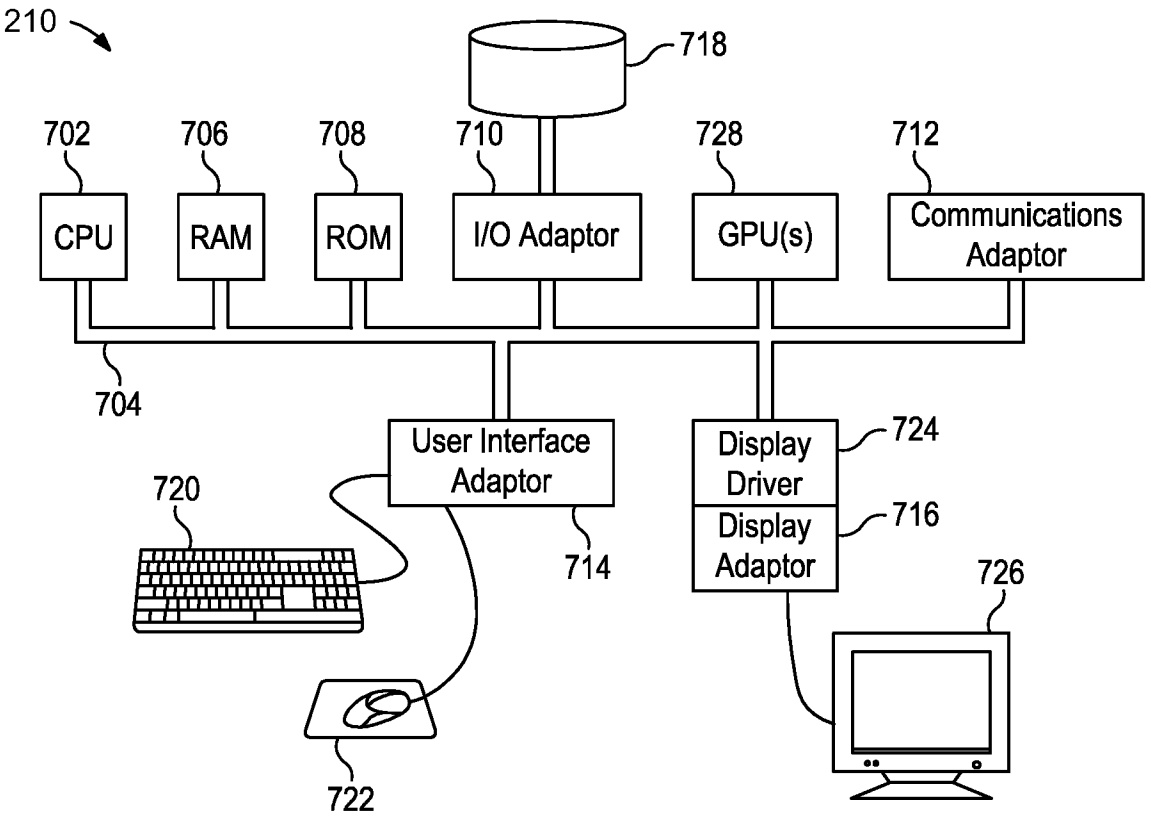
FIG. 7 is a block diagram of the computer system of FIG. 2 that may be used to execute any of the present systems.

FIG. 7 is a block diagram of the computer system 210 that may be used to execute any of the present systems. As illustrated, a central processing unit (CPU) 702 is coupled to a system bus 704. The CPU 702 may be any general-purpose CPU, although other types of architectures of the CPU 702 (or other components of the computer system 210) may be used as long as the CPU 702 (and other components of the computer system 210) supports the operations as described herein. Those of ordinary skill in the art will appreciate that, while only a single CPU 702 is shown in FIG. 7, additional CPUs may be present. Moreover, the computer system 210 may comprise a networked, multi-processor computer system that may include a hybrid parallel CPU/GPU system. The CPU 702 may execute the various logical instructions according to various teachings disclosed herein. For example, the CPU 702 may execute machine-level instructions for performing processing according to the operational flow described.

The computer system 210 may also include computer components such as non-transitory, computer-readable media. Examples of computer-readable media include a random access memory (RAM) 706, which may be SRAM, DRAM. SDRAM, or the like. The computer system 210 may also include additional non-transitory, computer-readable media such as a read-only memory (ROM) 708, which may be PROM, EPROM, EEPROM, or the like. RAM 706 and ROM 708 hold user and system data and programs, as is known in the art. The computer system 210 may also include an input/output (I/O) adapter 710, a communications adapter 712, a user interface adapter 714, and a display adapter 716.

The I/O adapter 710 may connect additional non-transitory, computer-readable media such as a storage device(s) 718, including, for example, a hard drive, a compact disc (CD) drive, a floppy disk drive, a tape drive, and the like to the computer system 210. The storage device(s) 718 may be used when RAM 706 is insufficient for the memory requirements associated with storing data for operations of the present techniques. The data storage of the computer system 210 may be used for storing information and/or other data used or generated as disclosed herein. For example, the storage device(s) 718 may be used to store configuration information or additional plug-ins in accordance with the present techniques. Further, the user interface adapter 714 couples user input devices, such as a keyboard 720, a pointing device 722 and/or output devices to the computer system 210. The display adapter 716 is driven by the CPU 702 to control, through a display driver 724, the display on a display device 726 to, for example, present information to the user regarding available plug-ins. This occurs, for example, through one or more graphical processing units (GPUs) 728.

The architecture of the computer system 210 may be varied as desired. For example, any suitable processor-based device may be used, including without limitation personal computers, laptop computers, computer workstations, and multi-processor servers. Moreover, the present technological advancement may be implemented on application specific integrated circuits (ASICs) or very large scale integrated (VLSI) circuits. In fact, persons of ordinary skill in the art may use any number of suitable hardware structures capable of executing logical operations according to the present technological advancement. The term "processing circuit" includes a hardware processor (such as those found in the hardware devices noted above), ASICs, and VLSI circuits. Input data to the computer system 210 may include various plug-ins and library files. Input data may additionally include configuration information.

The computer system 210 may be configured for remote access to facilitate software and programming updates, make changes, or clear faults. Also, the availability of the Bluetooth and onboard Wi-Fi will allow an operator remote access to the computer system 210, either wireless or wired, to control the unit from a remote location, or on site, such in a frac van or other tech van.

Embodiments disclosed herein include:

A. A wireline system that includes an operations cabin housing a plurality of electrical devices, a winch arranged adjacent the operations cabin and including an electric winch motor operable to drive a drum to manipulate a wireline cable, a first engine and a first electric generator each arranged within the operations cabin, the first engine being operable to drive the first electric generator to generate electrical power, a second electric generator driven by a second engine via a power takeoff to generate electrical power, an umbilical extending from the operations cabin and configured to be coupled to an external energy source that provides electrical power, and a battery pack arranged within the operations cabin and including one or more rechargeable batteries communicably coupled to the first and second electric generators and the umbilical, wherein the battery pack solely provides electrical power to the electric winch motor and the plurality of electrical devices, and wherein the first and second electric generators and the external energy source provide electrical power to recharge the one or more rechargeable batteries.

B. A method of operating a wireline system includes providing electrical power to an electric winch motor of a winch from a battery pack arranged within an operations cabin, wherein the battery pack includes one or more rechargeable batteries, generating electrical power with a first electric generator driven by a first engine, wherein the first electric generator and the first engine are each arranged within the operations cabin, generating electrical power with a second electric generator driven by a second engine via a power takeoff, receiving electrical power from an external energy source via an umbilical extending from the operations cabin, and recharging the one or more rechargeable batteries with the electrical power of one or more of the first and second electric generators and the external energy source.

C. A power pack module for a wireline system includes a housing, an engine and an electric generator each arranged within the housing, the engine being operable to drive the electric generator to generate electrical power, a first umbilical extending from the housing and configured to be coupled to an external energy source that provides electrical power, a battery pack arranged within the housing and including one or more rechargeable batteries communicably coupled to the electric generator and the first umbilical, and a second umbilical extending from the battery pack to provide electrical power to an electric winch motor operable to drive a drum to manipulate a wireline cable, wherein the battery pack solely provides electrical power to the electric winch motor, and wherein the electric generator and the external energy source provide electrical power to recharge the one or more rechargeable batteries.

Each of embodiments A, B, and C may have one or more of the following additional elements in any combination: Element 1: wherein the operations cabin and the winch are mounted to a chassis of a wireline truck, and wherein the second engine comprises an onboard engine of the wireline truck. Element 2: wherein the external energy source is selected from the group consisting of electrical grid power, electrical power derived from a renewable resource, a portable genset, and any combination thereof. Element 3: further comprising a computer system arranged in the operations cabin and programmed to operate the electric winch motor and control recharging of the one or more rechargeable batteries. Element 4: further comprising a power inverter in communication with the battery pack to receive and convert electrical power received from the battery pack for consumption by the plurality of electrical devices. Element 5: wherein the plurality of electrical devices are selected from the group consisting of a computer system, a wall outlet, a computer screen, a television monitor, a device charger, a heater, an air conditioner, a mooring system, and a security camera. Element 6: wherein the operations cabin and the winch are mounted to a trailer, and wherein the second engine comprises an engine of a vehicle used to tow the trailer. Element 7: wherein the operations cabin and the winch are mounted to a skid. Element 8: wherein the operations cabin and the winch are mounted to a continuous track assembly. Element 9: wherein the continuous track assembly includes one or more continuous tracks, and one or more electric motors arranged to drive the one or more continuous tracks, wherein electrical power required to operate each electric motor is provided by the battery pack.

Element 10: further comprising providing electrical power to a plurality of electrical devices within the operations cabin with the battery pack. Element 11: further comprising operating the electric winch motor and controlling recharging of the one or more rechargeable batteries with a computer system arranged in the operations cabin. Element 12: further comprising selectively regulating the recharging of the one or more rechargeable batteries with the computer system between the first and second electric generators and the external power source. Element 13: further comprising generating electrical power with the electric winch motor while dispensing wireline cable, and transmitting the electrical power generated by the electric winch motor to the battery pack and thereby recharging the one or more rechargeable batteries. Element 14: further comprising receiving excess electrical power from the battery pack at a load bank communicably coupled to the battery pack. Element 15: further comprising heating the operations cabin with heat generated by the load bank. Element 16: wherein the operations cabin and the winch are mounted to a continuous track assembly including one or more continuous tracks and one or more electric motors arranged to drive the one or more continuous tracks, the method further comprising providing electrical power from the battery pack to operate each electric motor.

Element 17: wherein the engine is a first engine and the electric generator is a first electric generator, the power pack module further comprising a second electric generator driven by a second engine via a power takeoff to generate electrical power, wherein the second electric generator also provides electrical power to recharge the one or more rechargeable batteries. Element 18: wherein the housing is transportable separate from the electric winch motor. Element 19: further comprising a computer system programmed to operate the electric winch motor and control recharging of the one or more rechargeable batteries. Element 20: wherein the housing is mounted to a trailer adjacent an operations cabin that includes a plurality of electrical devices, and wherein the battery pack provides electrical power to the plurality of electrical devices via the second umbilical.

By way of non-limiting example, exemplary combinations applicable to A, B, and C include: Element 4 with Element 5; Element 8 with Element 9; Element 11 with Element 12; Element 13 with Element 14; and Element 14 with Element 15.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, and the like are used in relation to the illustrative embodiments as they are depicted in the figures, the upward direction being toward the top of the corresponding figure and the downward direction being toward the bottom of the corresponding figure.

What is claimed is:

1. A wireline system, comprising:

an operations cabin housing a plurality of electrical devices;

a winch arranged adjacent the operations cabin and including an electric winch motor operable to drive a drum to manipulate a wireline cable;

a battery pack arranged within the operations cabin and including one or more rechargeable batteries that solely provide electrical power to the electric winch motor and the plurality of electrical devices;

a first engine and a first electric generator each arranged within the operations cabin to generate and convey electrical power directly to the battery pack to recharge the one or more rechargeable batteries;

a second electric generator driven by a second engine via a power takeoff to generate and convey electrical power directly to the battery pack to recharge the one or more rechargeable batteries; and an umbilical extending from the operations cabin and configured to be coupled to an external energy source that provides electrical power directly to the battery pack to recharge the one or more rechargeable batteries, wherein continuous and constant electrical power is provided to the electric winch motor during use by selectively switching between the first and second electric generators and the external energy source to recharge the one or more rechargeable batteries during use of the electric winch motor.

2. The wireline system of claim 1, wherein the operations cabin and the winch are mounted to a chassis of a wireline truck, and wherein the second engine comprises an onboard engine of the wireline truck.

3. The wireline system of claim 1, wherein the external energy source is selected from the group consisting of electrical grid power, electrical power derived from a renewable resource, a portable genset, and any combination thereof.

4. The wireline system of claim 1, further comprising a computer system arranged in the operations cabin and powered by the battery pack, the computer system being programmed to operate the electric winch motor by selectively regulating the recharging of the one or more rechargeable batteries between the first and second electric generators and the external power source during operation of the electric winch motor.

5. The wireline system of claim 4, wherein the computer system is further programmed to communicate with an operator in real-time regarding a capacity and power level of the battery pack.

6. The wireline system of claim 4, wherein the computer system is programmed to autonomously regulate recharging of the one or more rechargeable batteries between the first and second electric generators and the external power source during operation of the electric winch motor.

7. The wireline system of claim 1, wherein the operations cabin and the winch are mounted to a trailer, and wherein the second engine comprises an engine of a vehicle used to tow the trailer.

8. The wireline system of claim 1, wherein the operations cabin and the winch are mounted to a skid.

9. The wireline system of claim 1, wherein the operations cabin and the winch are mounted to a continuous track assembly.

10. The wireline system of claim 9, wherein the continuous track assembly includes:

one or more continuous tracks; and one or more electric motors arranged to drive the one or more continuous tracks, wherein electrical power required to operate each electric motor is provided by the battery pack.

11. A method of operating a wireline system, comprising:

providing electrical power to an electric winch motor of a winch from a battery pack arranged within an operations cabin, the battery pack including one or more rechargeable batteries;

generating electrical power with a first electric generator driven by a first engine, wherein the first electric generator and the first engine are each arranged within the operations cabin and the first electric generator conveys the electrical power directly to the battery pack;

generating electrical power with a second electric generator driven by a second engine via a power takeoff and conveying the electrical power directly to the battery pack;

receiving electrical power from an external energy source via an umbilical extending from the operations cabin and conveying the electrical power directly to the battery pack; and selectively switching between the first and second electric generators and the external energy source during use of the electric winch motor and thereby providing continuous and constant electrical power to the electric winch motor during use.

12. The method of claim 11, further comprising providing electrical power to a plurality of electrical devices within the operations cabin with the battery pack.

13. The method of claim 11, further comprising operating the electric winch motor and controlling recharging of the one or more rechargeable batteries with a computer system arranged in the operations cabin.

14. The method of claim 13, further comprising selectively regulating the recharging of the one or more rechargeable batteries with the computer system between the first and second electric generators and the external power source.

15. The method of claim 11, further comprising:

generating electrical power with the electric winch motor while dispensing wireline cable; and transmitting the electrical power generated by the electric winch motor to the battery pack and thereby recharging the one or more rechargeable batteries.

16. The method of claim 15, further comprising receiving excess electrical power from the battery pack at a load bank communicably coupled to the battery pack.

17. The method of claim 11, wherein the operations cabin and the winch are mounted to a continuous track assembly including one or more continuous tracks and one or more electric motors arranged to drive the one or more continuous tracks, the method further comprising providing electrical power from the battery pack to operate each electric motor.

18. A power pack module for a wireline system, comprising:

a housing;

a battery pack arranged within the housing and including one or more rechargeable batteries;

a first umbilical extending from the battery pack to provide electrical power to an electric winch motor operable to drive a drum to manipulate a wireline cable;

an engine and an electric generator each arranged within the housing to generate and convey electrical power directly to the battery pack to recharge the one or more rechargeable batteries;

a second umbilical extending from the housing and configured to be coupled to an external energy source that provides electrical power directly to the battery pack to recharge the one or more rechargeable batteries wherein the battery pack solely provides electrical power to the electric winch motor, and wherein continuous and constant electrical power is provided to the electric winch motor during use by selectively switching between the electric generator and the external energy source to recharge the one or more rechargeable batteries during use of the electric winch motor.

19. The power pack module of claim 18, wherein the engine is a first engine and the electric generator is a first electric generator, the power pack module further comprising a second electric generator driven by a second engine via a power takeoff to generate electrical power, wherein the second electric generator also provides electrical power to recharge the one or more rechargeable batteries.

20. The power pack module of claim 18, wherein the housing is transportable separate from the electric winch motor.

21. The power pack module of claim 18, further comprising a computer system programmed to operate the electric winch motor and selectively control recharging of the one or more rechargeable batteries between the first and second electric generators and the external power source.

22. The power pack module of claim 18, wherein the housing is mounted to a trailer adjacent an operations cabin that includes a plurality of electrical devices, and wherein the battery pack provides electrical power to the plurality of electrical devices via the first umbilical.

* * * * *